United States Patent [19]

Frehaut et al.

[11] Patent Number: 5,003,882

[45] Date of Patent: Apr. 2, 1991

[54] DEVICE FOR TILTING A SUB-MUNITION UNDER A PARACHUTE INTO INCLINED POSITION

[75] Inventors: Jean-Pierre Frehaut; Jean-Pierre Pineau, both of Orleans, France

[73] Assignee: Thomson-Brandt Armements, Boulogne Billancourt, France

[21] Appl. No.: 462,557

[22] Filed: Jan. 9, 1990

[30] Foreign Application Priority Data

Jan. 20, 1989 [FR] France ..... 89 00685

[51] Int. Cl.[5] ..... F42B 10/56; F42B 12/10

[52] U.S. Cl. ..... 102/387; 102/476

[58] Field of Search ..... 102/387, 386, 388, 306, 102/307, 475, 476

[56] References Cited

U.S. PATENT DOCUMENTS

| | | | |
|---|---|---|---|
| 4,050,387 | 9/1977 | Heinemann | 102/387 |
| 4,538,519 | 9/1985 | Witt et al. | 102/387 |
| 4,622,900 | 11/1986 | Witt et al. | 102/387 |
| 4,691,636 | 9/1987 | Witt et al. | 102/387 |
| 4,711,178 | 12/1987 | Argyrakis | 102/387 |
| 4,805,532 | 2/1989 | Synofzik et al. | 102/387 |
| 4,858,532 | 8/1989 | Persson et al. | 102/387 |

FOREIGN PATENT DOCUMENTS

| | | |
|---|---|---|
| 0126836 | 12/1984 | European Pat. Off. . |
| 2590663 | 5/1987 | France . |

*Primary Examiner*—David H. Brown

*Attorney, Agent, or Firm*—Oblon, Spivak, McClelland, Maier & Neustadt

[57] ABSTRACT

For suspending a sub-munition from a plate carried beneath a parachute, an arm is hinged with the plate and the body of the munition, and a structure has two positions for which the sub-munition is respectively vertical or inclined. The structure also includes a system of guiding the tilting between the two positions. The center of gravity of the sub-munition moves downwards on a vertical line during tilting of the sub-munition to an inclined position. The device forming the subject of the invention enables the swinging caused by tilting the sub-munition into an inclined position to be avoided, and it is simple and economical to manufacture.

7 Claims, 6 Drawing Sheets

DEVICE FOR TILTING A SUB-MUNITION UNDER A PARACHUTE INTO INCLINED POSITION

BACKGROUND OF THE INVENTION

The present invention concerns a device for tilting an object under a parachute, more specifically a sub-munition, into inclined position.

To bring an anti-tank guided effect type sub-munition into active phase, it is necessary to incline the munition with respect to the vertical, in order to obtain a spiral sweeping movement of the head of the munition, whatever the means used to brake it and set it rotating.

In addition, the tilting to an inclined position must be effected with minimal lateral displacement of the munition in order to avoid setting the unit swinging.

An easy solution would involve positioning an axis of rotation of a plate carrying the parachute lines at the level of the centre of gravity of the munition. This solution is however unsatisfactory, because the axis would then be at the level of the warhead, which would risk seriously perturbing its operation.

BRIEF SUMMARY OF THE INVENTION

An object of the invention is therefore to provide a device for tilting a sub-munition suspended from a parachute into an inclined position without these disadvantages.

According to the invention, a sub-munition is suspended, by primary and secondary means of suspension, from a plate intended to be carried under a parachute.

The primary means of suspension is formed by an arm hinged at its upper extremity to the plate and at its lower extremity to the body of the sub-munition, around parallel horizontal axes.

The secondary means of suspension has a structure with two positions: a first position in which the sub-munition is vertical, and a second position in which it is inclined, this said structure including also a means of guiding the movement from one position to the other, a means of locking into the first position and a means of release from this position.

The primary and secondary means of suspension are arranged in such a way that the centre of gravity of the sub-munition descends on a vertical line when it moves from the vertical position to the inclined position.

In the preferred form of embodiment, the secondary means of suspension consists of symmetrical oblong apertures in tabs fixed to the sub-munition, and axes or pins engaged in these apertures, fixed to the plate, the presence of the axes or pins at one or the other end of the said apertures determining the two positions of the second means of suspension, and the longitudinal shape of the apertures defining the means of guidance.

In another configuration of the invention, the said apertures are in tabs fixed to the plate, and the axes engaged in these apertures are fixed to the sub-munition.

The invention also concerns a means enabling the tilting of the sub-munition to be deferred with respect to the deployment of the parachute, this means being entirely mechanical and consisting of shaping of the said apertures combined with the presence of a spring compressed between the sub-munition and the plate.

BRIEF DESCRIPTION OF THE DRAWINGS

The characteristics of the invention mentioned above, and others, will appear more clearly on reading the following description of an example of embodiment, with relation to the figures accompanying this document, among which.

DESCRIPTION OF THE PREFERRED EMBODIMENT

Figure 1:
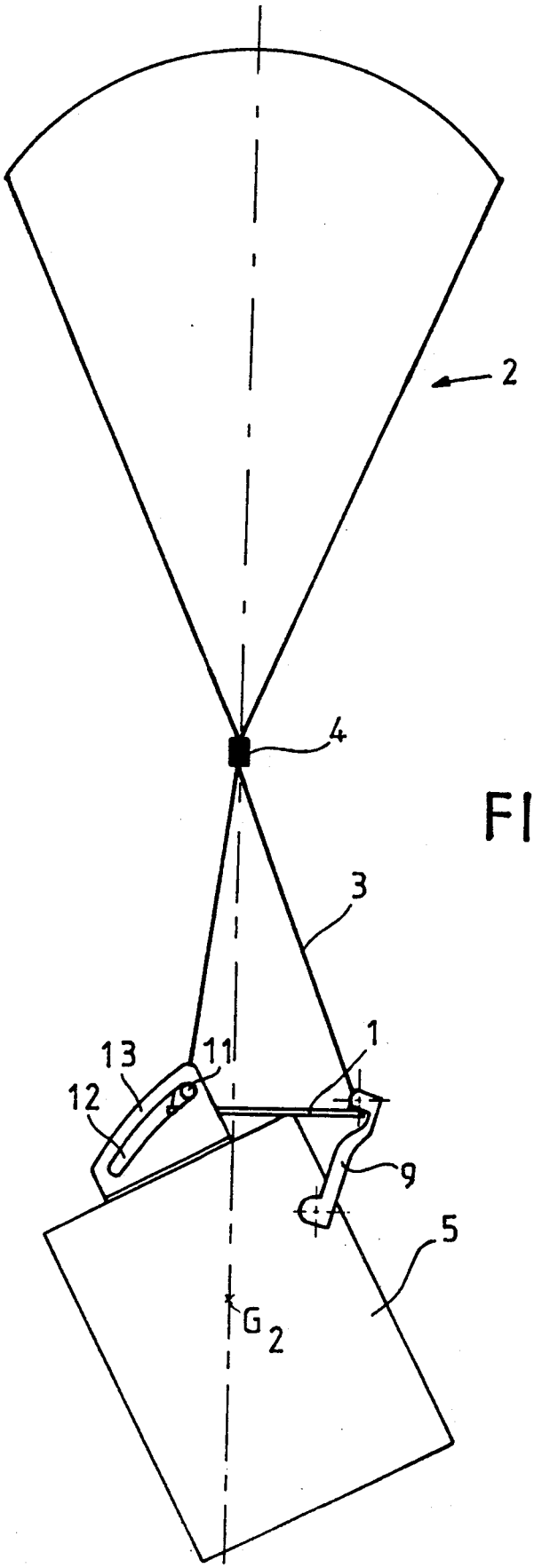
FIG. 1 is an overall view of a sub-munition suspended in inclined position from a plate carried horizontally under a parachute.

In FIG. 1, a plate 1, suspended horizontally under a parachute 2 by straps 3 and a swivel 4, carries a sub-munition 5. The plate 1, which is shown more clearly in FIG. 2, has three sides 1*a*, 1*b* and 1*c* which form a frame in the shape of an equilateral triangle. Each corner of the plate 1 is provided with an attachment 6 to which is fixed a strap 3. The attachments 6 are formed of first two vertical tabs 7 carrying between them portions of cylinder 8.

Figure 2:
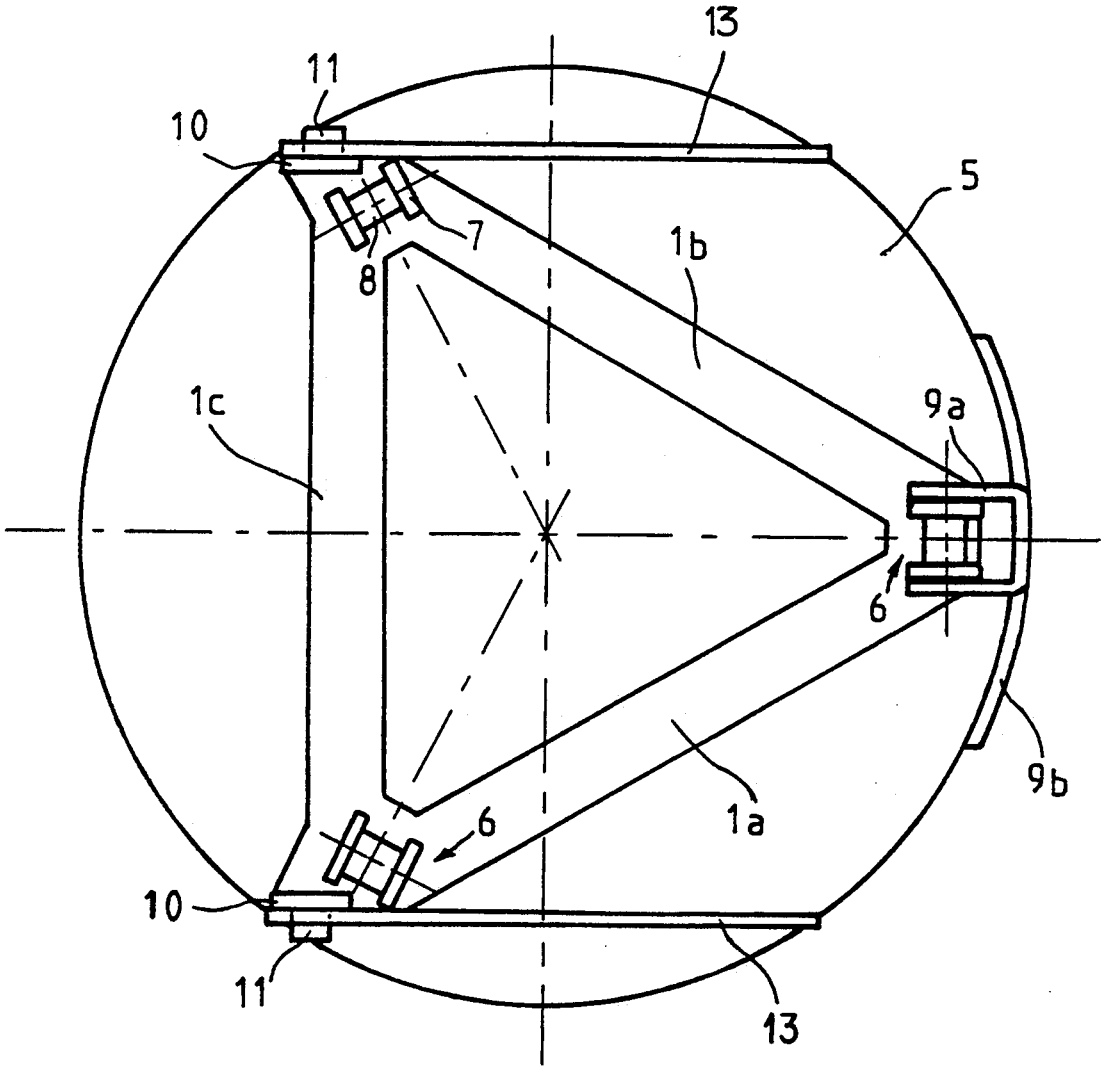
FIG. 2 is a bird's-eye view of the plate and the munition in vertical position under the said plate.

The tabs 7 of one of the attachments 6—that on the right in FIG. 2—include bearings maintaining a horizontal axis, parallel to side 1*c*, to which is hinged an arm 9 turned downwards. The arm 9 is composed of an upper part 9*a* and a lower part in two branches forming a yoke 9*b* hinged to the body of the sub-munition 5 around a horizontal axis also parallel to side 1*c*.

The two corners of the plate 1 at a distance from the arm include, near the attachments 6, second vertical tabs 10 perpendicular to the direction of side 1*c*. The planes of the external faces of the tabs 10 are towards the exterior with respect to the adjacent attachments 6. The tabs 10 have horizontal pins turned towards the exterior, parallel to the hinge axes of the arm 9.

Figure 3:
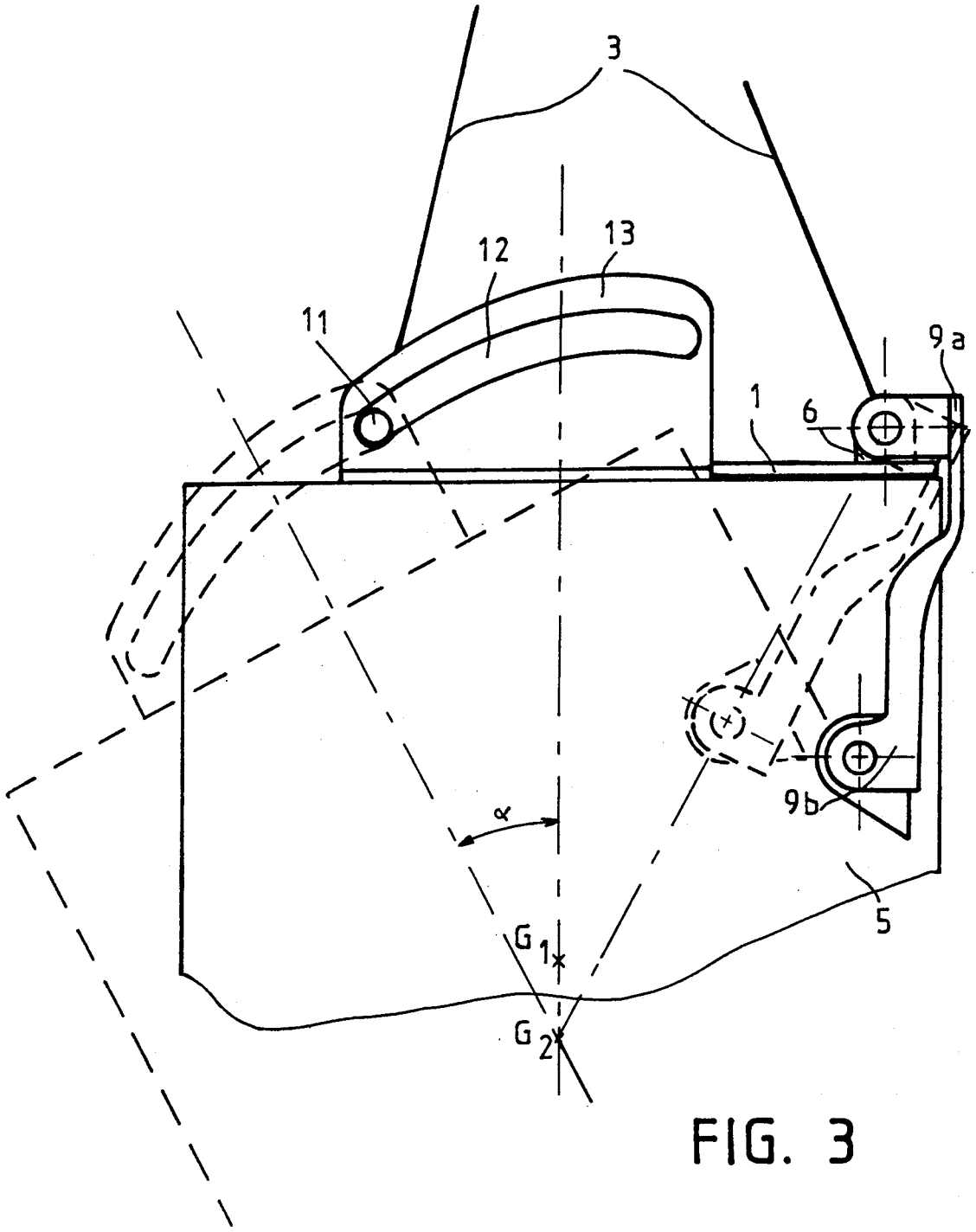
FIG. 3 is a side view of the plate and the sub-munition of FIG. 2, the broken lines representing the sub-munition in inclined position.

The pins 11 are engaged in respective apertures 12 which are in plates 13 fixed to the top of the sub-munition 5. The plates 13 are vertical and perpendicular to the direction of side 1*c*. The apertures 12 and the plates 13 are symmetrical with respect to the plane in which oscillates the arm 9. The extremities of the apertures 12 determine two positions of the sub-munition 5 with respect to plate 1: when the pins 11 are at the lower ends, the sub-munition 5 is in vertical position, represented by unbroken lines in FIG. 3, and when they are at the upper ends, the sub-munition is in inclined position with a desired angle of inclination $\alpha$, represented by broken lines. The positions of the upper extremities of the apertures 12 are also defined by the fact that in the inclined position of the sub-munition 5 which results from it, the centre of gravity G2 of the sub-munition is below the centre of gravity G1 of the sub-munition in vertical position, and on the same vertical, relative to the plate 1.

In addition, between their extremities, the apertures 12 have a shape such that during the relative movement of the pins 11 in the apertures from one extremity to the other, the centre of gravity of the sub-munition 5 moves vertically and in the same direction between the points G1 and G2 relative to the plate 1. The shape of the apertures 12 determined by this requirement is curved and is approximately that shown in FIG. 3. It will be noted that depending on the length of the arm 9, there is a maximum angle of inclination of the sub-munition 5, beyond which the centre of gravity of the sub-munition, instead of continuing to descend, would reascend during tilting. This position is defined in FIG. 3 by the segment delimited by G2 and the upper hinge axis of the arm 9, whose length is the sum of the distance between the two hinge axes of the arm 9 and the distance from the centre of gravity G of the sub-munition 5 to the lower hinge axis of the arm 9. In the example of embodiment shown, the apertures 12 and the arm 9 are arranged in such a way that the desired angle of inclination of the sub-munition is this maximum angle.

In its initial position, the sub-munition 5 is held vertically under plate 1 by locking the pins 11 in the lower ends of the apertures 12. Therefore, in operation, all that is needed is a means of releasing the pins 11 and providing a small force—using a spring, for example—or even no force at all to make the sub-munition take an inclined position, since gravity will contribute to the tilting. In practice, the assembly will be designed in such a way that the centre of gravity of the sub-munition is on the vertical passing through the swivel 4.

The means of releasing the pins 11 is preferably controlled by a delayed-action device, so as to defer the tilting of the sub-munition with respect to the braking phase. When the parachute opens, the deceleration can be very strong, of the order of several tens of times the acceleration due to gravity. The tilting of the sub-munition at this moment would be very brutal and would release a large amount of energy which would have to be absorbed. In addition, the tilting would provoke the high-speed opening of the rotation blades with which these sub-munitions are generally provided, and the intense aerodynamic forces which would act on these blades would require exceptionally large rotation shafts and stops for opening the blades. The systems commonly used are based on a delayed-action device commanding a mechanical action. They are of electromechanical, electro-pyrotechnic or entirely pyrotechnic type. Generally they are relatively expensive, and their complexity reduces the reliability of the assembly.

Figure 4:
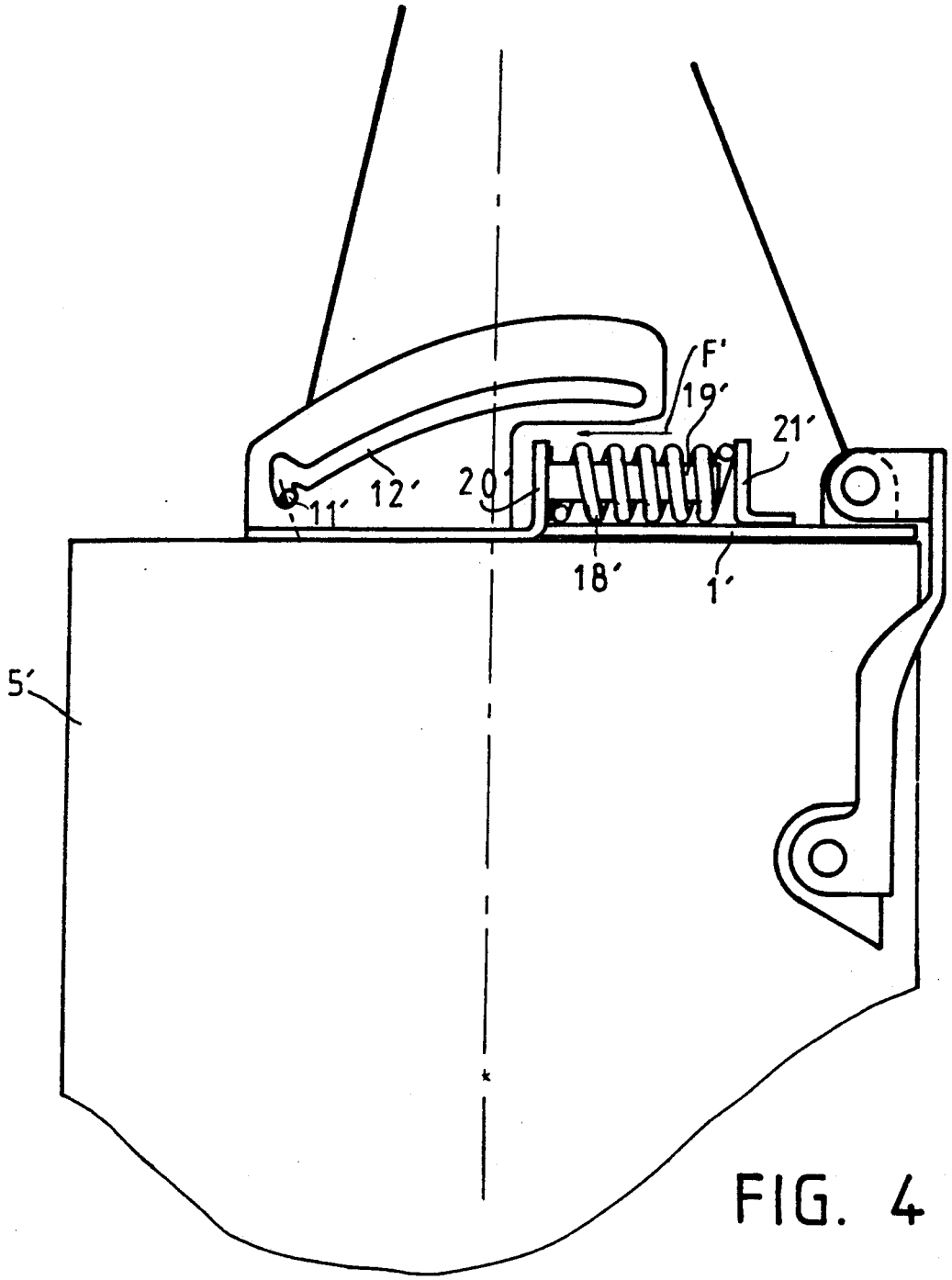
FIGS. 4 and 5 are views similar to that in FIG. 3, illustrating a tilting device according to the invention, complemented by a mechanical system to defer the tilting process.
Figure 5:
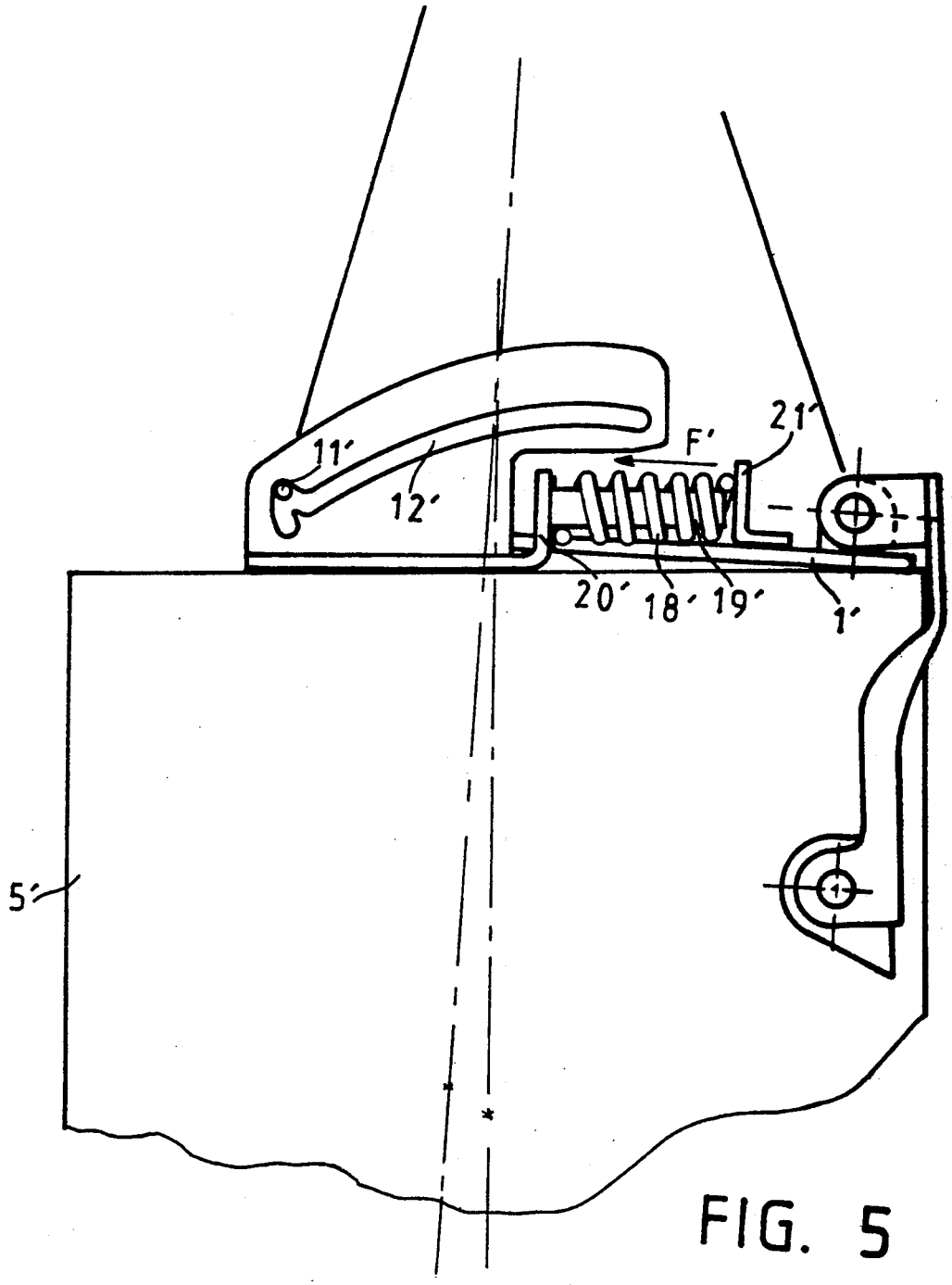
Figure 6:
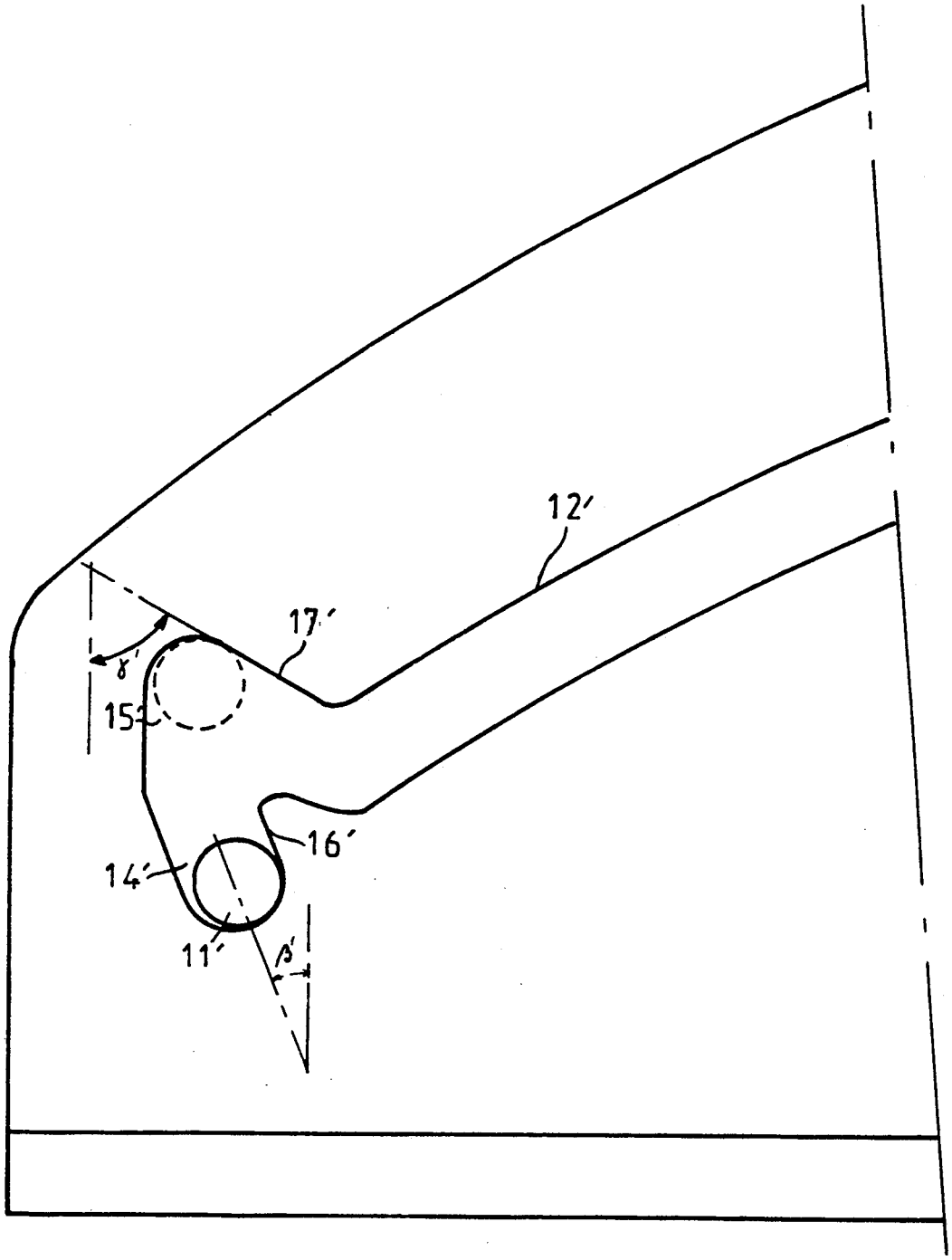
FIG. 6 is a partial and enlarged view of a detail of FIGS. 4 and 5.

The system illustrated in FIGS. 4 to 6 has the advantage of being entirely mechanical and very simple. It consists essentially of a particular shape of the extremity of each aperture 12 occupied by the pins 11 when the sub-munition is vertical, combined with the presence of an appropriate spring compressed between the top of the sub-munition and the plate.

This cut appears more clearly in FIG. 6. With respect to the aperture 12' it forms a first notch 14' downwards and a second notch 15' upwards. A first internal edge 16' of the notch 14' is inclined at a first angle $\beta'$ from the vertical, in contrast with the general direction of the aperture 12'. In the same way, a second internal edge 17' inclined at a second angle $\gamma'$ from the vertical, on the same side as the edge 16'.

The spring compressed between the sub-munition and the plate mentioned above appears in FIGS. 4 and 5 and bears the reference number 18'. It is placed around a bar 19' which is fixed to a third tab 20' fixed to the top of the sub-munition 5'. The spring 18' is compressed between the tabs 20' and 21' and exerts a horizontal force F'.

The force F' is more than sufficient to ensure locking of the pins 11' at the end of the notches 14', FIG. 6, until the parachute opens. The deceleration produced on opening is so great—of the order of several tens of times the acceleration due to gravity—that under the effect of the mass of the sub-munition 5', the force F' is overcome, the pins 11' sliding on the edge 16' of the notches 14', being released, and moving into the notches 15', FIG. 5. As long as the deceleration remains great, the pins i1' remain forced to the end of the notches 15', in spite of the action of the spring 18'. The value of the angle $\gamma'$ and that of the force F' are calculated such that the pins 11' slide on the internal edge 17' of the notches 15' when the deceleration produced by the parachute still has a value of approximately twice the acceleration due to gravity, in order to have good reliability of the system.

Of course, the passage of the pins 11' from the notch 14' to the notch 15', and then from the notch 15' into the main part of the aperture 12', causes a slight lateral displacement of the centre of gravity of the sub-munition 5'. However, this lateral displacement precedes the tilting, and the disadvantages resulting from it are more than compensated for by the fact that the tilting takes place under considerably weaker conditions of velocity and forces.

In other forms of embodiment, the tabs including the apertures 12 or 12' may be fixed to the plate and the pins 11 or 11' to the sub-munition.

Apart from the advantages that the tilting of the sub-munition takes place without lateral displacement of its centre of gravity, and therefore without risk of swing of the assembly provoked by this tilting, and that the relative downward movement of the centre of gravity during tilting enables this to be performed practically without the use of extra force, it should be noted that it is possible to manufacture it in stamped sheet metal, thus economically.

What is claimed is:

1. Device for tilting a sub-munition under a parachute into an inclined position, comprising a plate intended to be carried under the said parachute, and including primary and secondary means of suspending the said sub-munition from the plate, the primary means of suspension being formed of an arm with an upper and a lower end hinged to the plate and the sub-munition respectively, about horizontal parallel axes, the secondary means of suspension having a structure with two positions: one position in which the sub-munition is vertical and another in which it is inclined, this structure also comprising a means for guiding the tilting from the vertical to the inclined position along a path such that the center of gravity of the sub-munition moves downward along a vertical line during said tilting, a means of locking it in the first position and a means of releasing it from the first position.

2. Device according to claim 1, wherein the means of release of the secondary means of suspension is a delayed-action device.

3. Device according to claim 1, wherein the said secondary means of suspension is of the type with an axis or pin engaged in an oblong aperture, the two positions of the secondary means of suspension being determined by a presence of this axis or pin at each extremity of the aperture, and the means for guiding the tilting being defined by a longitudinal shape of the said aperture.

4. Device according to claim 3, wherein the said secondary means of suspension includes two symmetrical oblong apertures in tabs which are fixed to the upper extremity of the sub-munition, and axes or pins engaged in these apertures, which form part of the plate.

5. Device according to claim 3, including also a means of deferring the tilting of the sub-munition with respect to the deployment of the parachute, this means consisting of cutting in the shape of notches and the extremity of the apertures occupied by the pins when the sub-munition is not tilted, combined with the presence of a spring compressed between the top of the sub-munition and the plate.

6. Device according to claim 5, wherein a force F′ of a spring and a first angle of a first internal edge of a first notch are such that a deceleration of the order of several tens of times that of the acceleration due to gravity is necessary to release the pins from the notches.

7. Device according to claim 6, wherein a second angle of a second internal edge of a second notch is such that a deceleration produced by the parachute must fail to a value of the order to twice the acceleration due to gravity for the force F′ of the spring to be sufficient to release the pins from the notches.

* * * * *